US010078985B2

(12) United States Patent
Mori

(10) Patent No.: US 10,078,985 B2
(45) Date of Patent: Sep. 18, 2018

(54) LIQUID CRYSTAL DISPLAY

(71) Applicant: MITSUBISHI ELECTRIC CORPORATION, Tokyo (JP)

(72) Inventor: Akihiro Mori, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 65 days.

(21) Appl. No.: 15/171,424

(22) Filed: Jun. 2, 2016

(65) Prior Publication Data

US 2016/0358557 A1 Dec. 8, 2016

(30) Foreign Application Priority Data

Jun. 8, 2015 (JP) ..... 2015-115820

(51) Int. Cl.
*G09G 3/34* (2006.01)
*G09G 5/02* (2006.01)

(52) U.S. Cl.
CPC ..... *G09G 3/3413* (2013.01); *G09G 3/3406* (2013.01); *G09G 5/026* (2013.01); *G09G 2320/0242* (2013.01); *G09G 2320/064* (2013.01); *G09G 2320/0646* (2013.01); *G09G 2320/0666* (2013.01); *G09G 2360/16* (2013.01)

(58) Field of Classification Search
None
See application file for complete search history.

(56) References Cited

U.S. PATENT DOCUMENTS 7,295,180 B2 11/2007 Ichikawa et al.
8,193,734 B2 6/2012 Chen et al.
8,624,823 B2 1/2014 Park et al.
2004/0196225 A1 10/2004 Shimada
2010/0079429 A1* 4/2010 Hirose ..... G09G 3/3426 345/209
2013/0038212 A1* 2/2013 Yabuta ..... G02F 1/133603 315/113
2014/0340431 A1* 11/2014 Yamakawa ..... G09G 3/3426 345/690

FOREIGN PATENT DOCUMENTS

JP 2001-272938 A 10/2001
JP 2004-311635 A 11/2004
JP 2006-171695 A 6/2006
JP 4156919 B2 9/2008
JP 2009-139945 A 6/2009
JP 2010-109327 A 5/2010
JP 2014-227496 A 12/2014

* cited by examiner

*Primary Examiner* — Christopher Kohlman
(74) *Attorney, Agent, or Firm* — Studebaker & Brackett PC

(57) ABSTRACT

A liquid crystal display includes: a liquid-crystal-display device; a display control circuit; a backlight device; and a light-emitting-diode control circuit that adjusts luminance of the backlight device using a pulse width modulation signal as an output to the white light emitting diode. Gradation correction data corresponding to a chromaticity variation due to a duty ratio of the pulse width modulation signal is stored in the display control circuit in advance, the display control circuit determines the gradation correction data corresponding to input image data input to the liquid crystal display, based on the input image data and the duty ratio, and the display control circuit outputs output image data, which is calculated so as to correct the chromaticity variation based on the gradation correction data and the input image data, as the image signal to the liquid-crystal-display device.

4 Claims, 6 Drawing Sheets

FIG.11

| DUTY RATIO 10% | |
|---|---|
| GRADATION VALUE | CORRECTION DATA |
| 0 | 0 |
| 1 | 0 |
| 2 | 0 |
| 3 | 0 |
| 4 | 1 |
| 5 | 1 |
| . | . |
| . | . |
| . | . |
| 119 | 14 |
| 120 | 14 |
| 121 | 15 |
| . | . |
| . | . |
| . | . |
| . | . |
| 251 | 30 |
| 252 | 30 |
| 253 | 30 |
| 254 | 31 |
| 255 | 31 |

* * * * *

| DUTY RATIO 40% | | DUTY RATIO 50% | | DUTY RATIO 60% | |
|---|---|---|---|---|---|
| GRADATION VALUE | CORRECTION DATA | GRADATION VALUE | CORRECTION DATA | GRADATION VALUE | CORRECTION DATA |
| 0 | 0 | 0 | 0 | 0 | 0 |
| 1 | 1 | 1 | 1 | 1 | 1 |
| 2 | 1 | 2 | 1 | 2 | 1 |
| 3 | 1 | 3 | 1 | 3 | 1 |
| 4 | 1 | 4 | 1 | 4 | 1 |
| 5 | 2 | 5 | 2 | 5 | 2 |
| . | . | . | . | . | . |
| . | . | . | . | . | . |
| . | . | . | . | . | . |
| 119 | 15 | 119 | 17 | 119 | 15 |
| 120 | 16 | 120 | 17 | 120 | 15 |
| 121 | 16 | 121 | 18 | 121 | 16 |
| . | . | . | . | . | . |
| . | . | . | . | . | . |
| . | . | . | . | . | . |
| . | . | . | . | . | . |
| 251 | 36 | 251 | 36 | 251 | 36 |
| 252 | 36 | 252 | 36 | 252 | 36 |
| 253 | 36 | 253 | 36 | 253 | 36 |
| 254 | 36 | 254 | 37 | 254 | 36 |
| 255 | 36 | 255 | 38 | 255 | 36 |

* * * * *

| DUTY RATIO 90% | |
|---|---|
| GRADATION VALUE | CORRECTION DATA |
| 0 | 0 |
| 1 | 0 |
| 2 | 0 |
| 3 | 0 |
| 4 | 0 |
| 5 | 0 |
| . | . |
| . | . |
| . | . |
| 119 | 9 |
| 120 | 10 |
| 121 | 10 |
| . | . |
| . | . |
| . | . |
| . | . |
| 251 | 19 |
| 252 | 20 |
| 253 | 20 |
| 254 | 20 |
| 255 | 20 |

LIQUID CRYSTAL DISPLAY

CROSS-REFERENCE TO RELATED APPLICATION

This application claims priority from Japanese Patent Application No. 2015-115820 filed on Jun. 8, 2015, the entire subject matter of which is incorporated herein by reference.

TECHNICAL FIELD

This disclosure relates to a liquid crystal display and can be suitably applied for a liquid crystal display including a backlight device employing a white light emitting diode as a light source.

BACKGROUND

Electronic information devices is become widely used, and thin and light liquid crystal have been used for mobile phones, PC displays, various apparatuses for industrial applications, on-board displays, handy terminals, or advertisement displays, and the like. Liquid crystal displays in which an input device such as a touch panel or a transparent plate for screen protection is combined with a front surface of a liquid crystal display panel, for example displays of ticket vending machines and automatic teller machines (ATM) and mobile terminals such as mobile phones or tablet PCs, have been widely used.

Most liquid crystal displays include a transmissive liquid crystal display panel, in which RGB (three primary colors of red, green, and blue) color filters are disposed for each pixel, as a display device, and irradiate the liquid crystal display panel with light from a backlight device disposed on the rear surface thereof and controlling a voltage applied to the liquid crystal based on an input signal adjust transmitted light intensity for each pixel, thereby displaying images.

In some of the displays provided with the liquid crystal display panel, a function of adjusting luminance of the backlight device is required depending on brightness of a work environment (such as daytime, nighttime, or office lighting), mode setting for suppressing consumption of a battery, or the like. As means thereof, a method, in which a voltage applied to a light source device is controlled to adjust to a current flowing in the light source device and to raise or lower emission illuminance of the light source, or a pulse width modulation (hereinafter, abbreviated to PWM) method, in which a voltage applied to a light source device is kept at constant, the voltage to the light source device is intermittently turned on/off at a constant frequency, and thereby luminance is adjusted based on a ratio thereof (duty ratio), are generally used.

As a light source which is used as a backlight device, a white light emitting diode (hereinafter, referred to as "LED") in which a yellow fluorescent substance is combined with a blue LED has been mainly used. In recent years, a remarkable increase in luminance and an increase in emission efficiency of the LED have been realized. Further, a decrease in size, an increase in luminance, and a decrease in power consumption of a liquid crystal display have been achieved by using such white LED. However, when the above-mentioned white LED is used as a light source device, due to wavelength characteristics of emitted light, it is difficult to reproduce a vivid color, specifically red having a specifically long wavelength.

Therefore, a structure is known in which a color reproducible range is broadened by using RGB LEDs having different luminescent colors as light source devices. In such structure, a light emitted from the light sources having different colors is incident on a mixing light guide plate different from a light guide plate, with which the display surface is irradiated, and propagates a sufficient distance, thereby the RGB colors are mixed to omit unevenness and are incident on a light guide plate (Japanese Patent No. 4156919).

On the other hand, an LED device is also widely known in which a color reproducible range is broadened by combining a blue LED with a fluorescent substance having emission characteristics improved at a wavelength in a red region when being excited with the blue LED light source (Japanese Unexamined Patent Application Publication No. 2014-227496).

SUMMARY

In the liquid crystal display described in Japanese Patent No. 4156919, since the mixing light guide plate or a reflective member for returning light from the mixing light guide plate by 180 degrees is required for obtaining uniformly-mixed light emitted from the backlight device, there is a problem in that the size or weight of the display increase and the number of components increase to complicate the structure thereof.

Further, due to differences in temperature and life span characteristics among the RGB LEDs, it is necessary to provide sensors corresponding to RGB and to feed signals from the sensors back to control the outputs of the colors LEDs in order to obtain chromaticity based on the specification regardless of the operating conditions thereof.

In the liquid crystal display using an LED including a fluorescent substance as a light source as described in Japanese Unexamined Patent Application Publication No. 2014-227496, it is possible to improve color reproducibility with the same structure and chromaticity uniformity as the liquid crystal display using an LED in which a blue LED and a yellow fluorescent substance are combined in the background art. However, when luminance control is performed by using the PWM, characteristics vary at a rising edge and a falling edge when each color fluorescent substance is excited to emit light, and white chromaticity may vary from the set specification depending on the frequency or the duty ratio of a PWM signal. Specifically, when luminance adjustment is performed using the PWM, there is a problem in that the white chromaticity is likely to vary to a red side due to persistence characteristics in the red fluorescent substance.

This disclosure provides a liquid crystal display that has a small chromaticity variation even when luminance of a light source using PWM using white LEDs employing fluorescent substance having different emission response characteristics as a light source device.

A liquid crystal display of this disclosure includes: a liquid-crystal-display device, which includes a color filter substrate and a thin-film-transistor substrate; a display control circuit, which generates an image signal to control display of the liquid-crystal-display device; a backlight device, which is disposed on a rear surface of the liquid-crystal-display device, includes at least one white light emitting diode, and emits planar light from an emission surface; and a light-emitting-diode control circuit that adjusts luminance of the backlight device using a pulse width modulation signal as an output to the white light emitting diode, wherein gradation correction data corresponding to a chromaticity variation due to a duty ratio of the pulse width modulation signal is stored in the display control circuit in advance, wherein the display control circuit determines the gradation correction data corresponding to input image data input to the liquid crystal display, based on the input image data and the duty ratio, and wherein the display control circuit outputs output image data, which is calculated so as to correct the chromaticity variation based on the gradation correction data and the input image data, as the image signal to the liquid-crystal-display device According to this disclosure, it is possible to provide a liquid crystal display that has a small chromaticity variation from a set chromaticity specification even in a case where luminance is adjusted using PWM while widening a color reproducible range using white LEDs employing fluorescent substance having different emission response characteristics as a light source device.

BRIEF DESCRIPTION OF THE DRAWINGS

The foregoing and additional features and characteristics of this disclosure will become more apparent from the following detailed descriptions considered with the reference to the accompanying drawings, wherein:

FIG. 11 is a diagram illustrating details of a data table according to the first embodiment of this disclosure.

DETAILED DESCRIPTION

Figure 1:
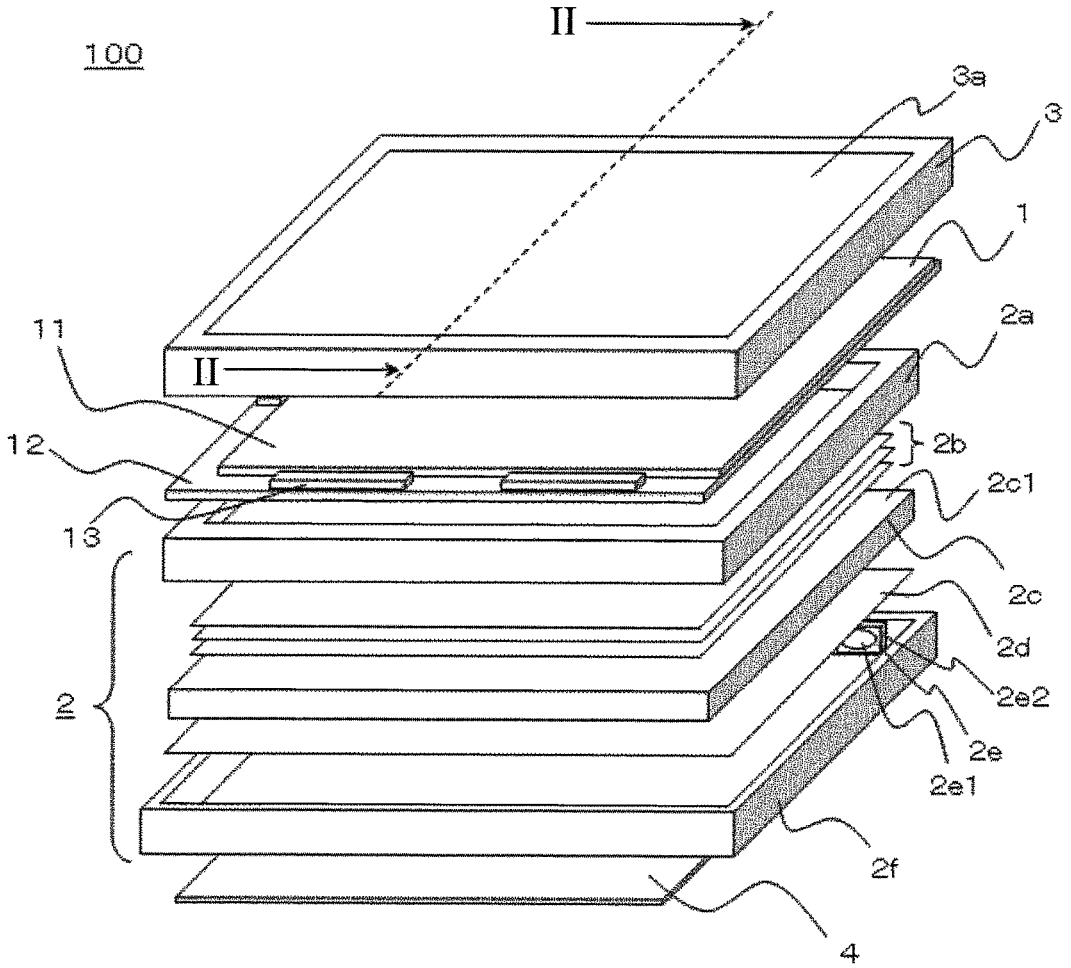
FIG. 1 is an exploded perspective view of a liquid crystal display according to first to third embodiments of this disclosure.

Hereinafter, embodiments of this disclosure will be described with reference to the accompanying drawings. In order to avoid repetition and redundancy of explanation, elements having like or corresponding functions in the drawings will be referenced by like reference signs.

First Embodiment

Figure 2:
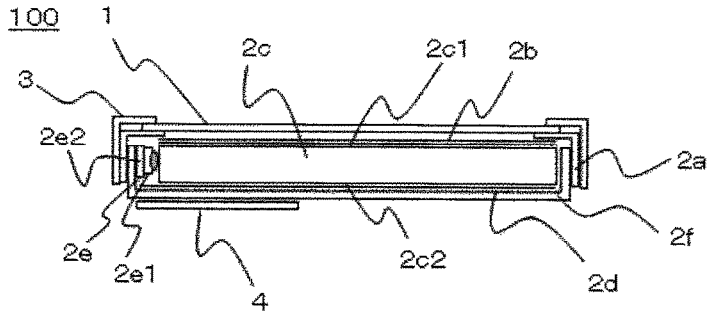
FIG. 2 is a cross-sectional view illustrating a state where the liquid crystal display illustrated in FIG. 1 is assembled when viewed from an II-II direction.

Now, an embodiment of this disclosure will be described with reference to the drawings. FIG. 1 is an exploded perspective view illustrating a configuration of a liquid crystal display according to a first embodiment of this disclosure. FIG. 2 is a cross-sectional view illustrating a state where the liquid crystal display illustrated in FIG. 1 is assembled when viewed from an II-II direction.

[Entire Configuration]

As illustrated in FIGS. 1 and 2, a liquid crystal display 100 according to this disclosure includes a LCD device 1, a backlight device 2 that irradiates the LCD device 1 from the rear surface thereof, a front frame 3 that has the LCD device 1 and the backlight device 2 disposed therein and includes a display opening 3*a*, and a control circuit board 4, on which a display control circuit 5 (to be described later) controlling transmittance of each pixel of the LCD device 1 based on an input image signal, is mounted.

The elements of the liquid crystal display 100 according to this disclosure will be described below in detail.

[Configuration of Liquid Crystal Display]

The LCD device 1 is a transmissive or transflective liquid crystal display panel and includes a color filter substrate 11 (first substrate) in which a color filter, a light blocking layer, a counter electrode, and the like are formed on an insulating substrate of glass or the like and a TFT substrate 12 (second substrate) in which thin film transistors (hereinafter, referred to as TFT) serving as switching elements, pixel electrodes, and the like are formed on an insulating substrate made of glass or the like.

Between the color filter substrate 11 and the TFT substrate 12 of the LCD device 1, a spacer (not illustrated) for holding a predetermined gap between the two substrates, a seal member (not illustrated) bonding the color filter substrate 11 and the TFT substrate 12 to each other to interpose liquid crystal therebetween, an encapsulant (not illustrated) of an injection port for injecting the liquid crystal, and an alignment film (not illustrated) aligning the liquid crystal are disposed. A polarizing film (not illustrated) is also disposed on outer surfaces of both substrates.

A driver IC 13 outputting a drive signal of the liquid crystal is mounted on the outer periphery of the TFT substrate 12 in a chip-on-glass (COG) manner. A flexible printed circuit (FPC) (not illustrated) connecting the driver IC 13 to the display control board 4 is mounted on an end of the TFT substrate 12.

[Configuration of Backlight Device]

The backlight device 2 includes a light source unit 2*e* that emits light, a light guide plate 2*c* that causes the light emitted from the light source unit 2*e* to propagate, an optical sheet 2*b* that is disposed on an emission surface 2*c*1 of the light guide plate 2*c* to control distribution or diffusion of the light emitted from the light guide plate 2*c*, a reflective sheet 2*d* that returns light leaking to a non-emission surface 2*c*2 of the light guide plate 2*c* to the light guide plate 2*c*, and a rear frame 2*f* that holds the members.

The backlight device 2 is disposed on the TFT substrate 12 side opposite to the display surface of the LCD device 1 and irradiates the LCD device 1 from the rear side.

In this embodiment, a white LED 2*e*1 in which a blue LED and fluorescent substance to be excited with blue light are combined to emit white light by mixture of light from the blue LED and light emitted from the fluorescent substance is employed as the light source unit 2*e*. Plural white LEDs 2*e*1 are arranged on a light source substrate 2*e*2.

Therefore, a substrate using a general glass epoxy resin as a base or a flexible flat cable may be used as the light source substrate 2*e*2 on which the white LEDs 2*e*1 are mounted, or a substrate using metal such as aluminum or ceramics as a base may be used to enhance heat dissipation.

The light guide plate 2*c* is made of a transparent acryl resin, a polycarbonate resin, glass, or the like, and a scattering dot pattern or a prism pattern is formed on the non-emission surface 2*c*2 or/and the emission surface 2*c*1 of the light guide plate 2*c* for the purpose of emitting light and adjusting a light intensity distribution in the display surface or an emission direction.

The optical sheet 2*b* is disposed on the light guide plate 2*c* so as to adjust the intensity distribution, the emission angle, and the uniformity of emitted light. A lens sheet for focusing the light, a diffusion sheet for uniformization of light, a viewing angle adjustment sheet for adjustment of luminance in a viewing angle direction, and the like are disposed as the optical sheet 2*b*, as a necessary number of sheets depending on its purpose.

The middle frame 2*a* includes an opening for emitting light from the emission surface 2*c*1 of the light guide plate 2*c*, and the LCD device 1 is mounted, positioned, and held in the periphery of the top surface. Metal such as aluminum, stainless, or iron or a resin material such as polycarbonate (PC) or acrylonitrile butadiene styrene (ABS) can be used as the material of the middle frame 2*a*.

The rear frame 2*f* is configured to be fitted to the middle frame 2*a*, and the light source unit 2*e*, the light guide plate 2*c*, and the reflective sheet 2*d* are held in a predetermined order in the fitted inside.

The light source unit 2*e* is positioned and held in the rear frame 2*f*. Accordingly, in order to conduct heat emitted from the light source unit 2*e*, it is preferable that metal having high thermal conductivity be used for the rear frame 2*f*. Specifically, by using a frame made of aluminum or aluminum alloy having high thermal conductivity, it is possible to efficiently dissipate heat from the light source unit 2*e* and to prevent heat from being accumulated in the backlight device 2.

Depending on restrictions in size or structure of the liquid crystal display 100, the light source unit 2*e* may be attached to a member other than the rear frame 2*f*, such as the middle frame 2*a* or the light guide plate 2*c*.

The middle frame 2*a* and the rear frame 2*f* are generally fitted and fixed to each other by an engagement structure using a claw or screwing and hold the other backlight members, the LCD device 1, the control circuit board 4, and the like, but both may be formed as a unified structure.

[Configuration of Front Frame]

The front frame 3 is a frame-like member that holds the LCD device 1, the backlight device 2, a protective member (not illustrated), and the like, is formed of a metal sheet of aluminum, stainless steel, iron, or the like or a resin molded product of polycarbonate (PC) or acrylonitrile butadiene styrene (ABS), and the front frame 3 is fitted and fixed to the backlight device 2 by an engagement structure using a claw or screwing. The front frame 3 may be formed as a unified body, may be configured by combining plural members, or attachment portions (screws, attachment holes, and the like) to a display body (not illustrated) to which the liquid crystal display 100 is attached may be formed in a side surface, a front surface, a rear surface, or a periphery thereof.

[Configuration of Control Circuit Board]

The control circuit board 4 has a display control circuit 5 (to be described later) mounted thereon to control the LCD device 1 or the light source unit 2*e* by using an electrical signal. On the control circuit board 4, a copper pattern is generally formed on a glass epoxy substrate or the like so as, and an electronic component is soldered and mounted on the surface thereof. As illustrated in FIGS. 1 and 2, the control circuit board 4 is disposed and fixed to the rear side (one side from which light is not emitted) of the liquid crystal display 100. In order to protect the control circuit board 4 from an external pressure or static elasticity, a protective cover (not illustrated) formed of metal such as aluminum, stainless steel, or a zinc-plated steel sheet or a film-like thin resin of polyethylene terephthalate (PET) may be attached. When a metal protective cover is used, it is preferable that a resin sheet of PET or the like (not illustrated) for insulation is bonded to the control circuit board 4 side so as to avoid electrical contact to the control circuit board 4 or the electronic component on the control circuit board 4.

A circuit unit of the control circuit board 4 that controls the LCD device 1 and a circuit unit that controls the light source unit 2*e* may be formed on the same substrate or may be formed on separate substrates. The control circuit board 4 may have a configuration in which a necessary electronic component is mounted on an FPC attached to an end of the LCD device 1.

[Configuration of Light Source Unit]

Figure 3:
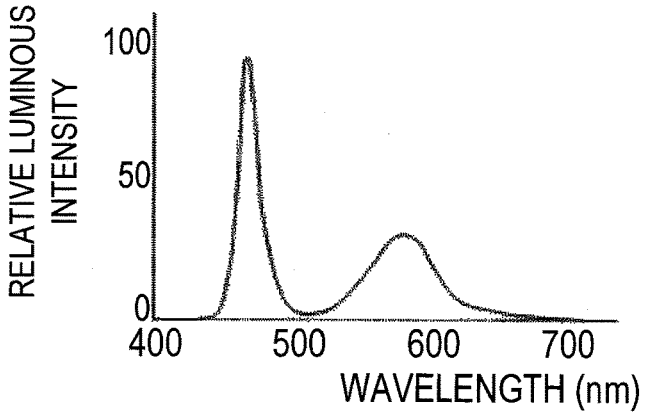
FIG. 3 is an emission spectrum diagram of a white LED according to the background art.
Figure 4:
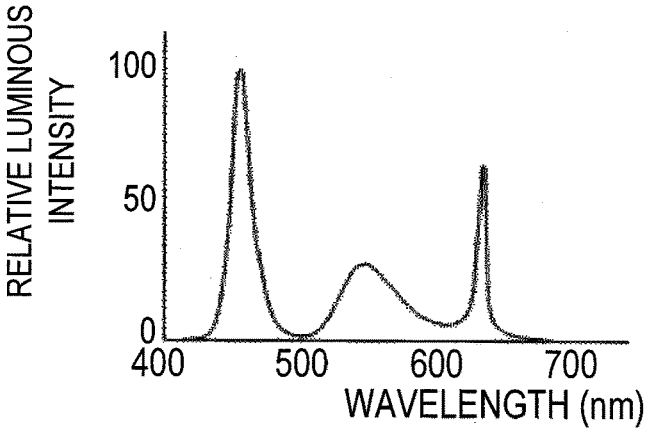
FIG. 4 is an emission spectrum diagram of a white LED according to the first to third embodiments of this disclosure.

As described above, in this embodiment, the white LED 2*e*1, in which fluorescent substance excited with blue light is combined with a blue LED to emit white light by mixture of light from the blue LED and light emitted from the fluorescent substance, is employed as the white LED 2*e*1 of the light source unit 2*e*. In this embodiment, an LED in which a blue LED is combined with fluorescent substance having a peak in wavelength regions of green and red to improve color reproducibility is employed as the white LED 2*e*1. FIG. 4 illustrates an emission spectrum distribution diagram of the white LED 2*e*1 which is employed in this embodiment. In the white LED illustrated in FIG. 4, in comparison with the emission spectrum distribution diagram of the white LED according to the background art illustrated in FIG. 3, since a clear peak is present in the wavelength regions of green and red, it is possible to reproduce a wider color range. Specifically, it is possible to improve red reproducibility which is poor in the white LED according to the background art using the yellow fluorescent substance illustrated in FIG. 3.

[Configuration of Display Control Circuit]

Figure 10:
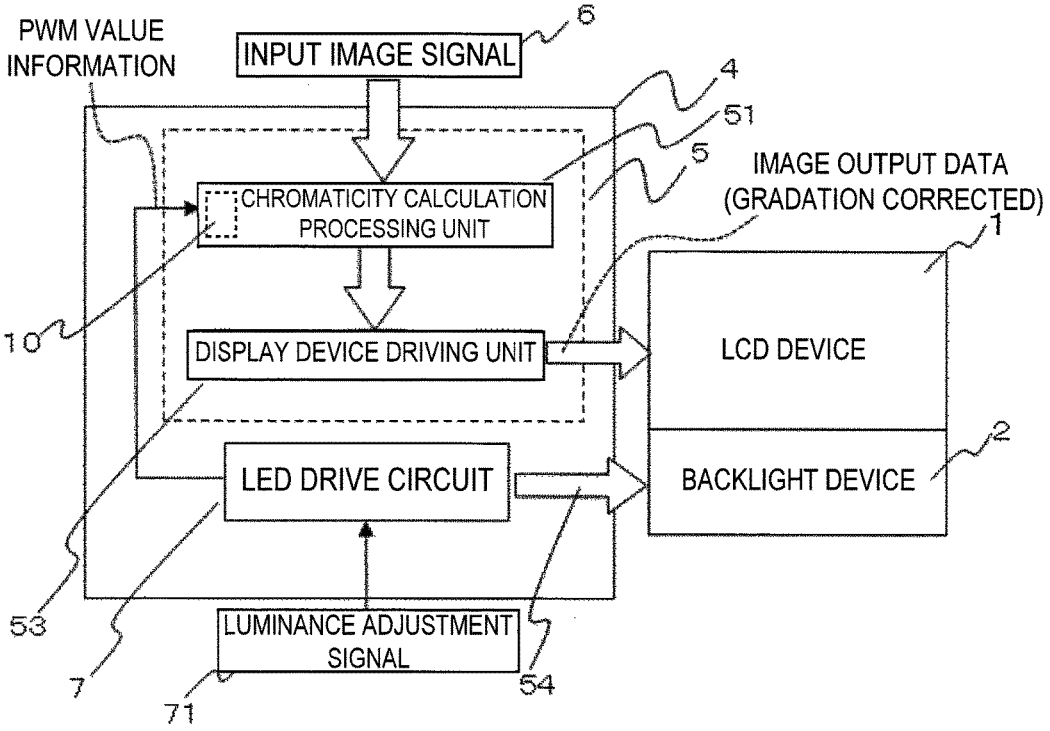
FIG. 10 is a block diagram of a control circuit board which is mounted on the liquid crystal display according to the first embodiment of this disclosure.
Figure 12:
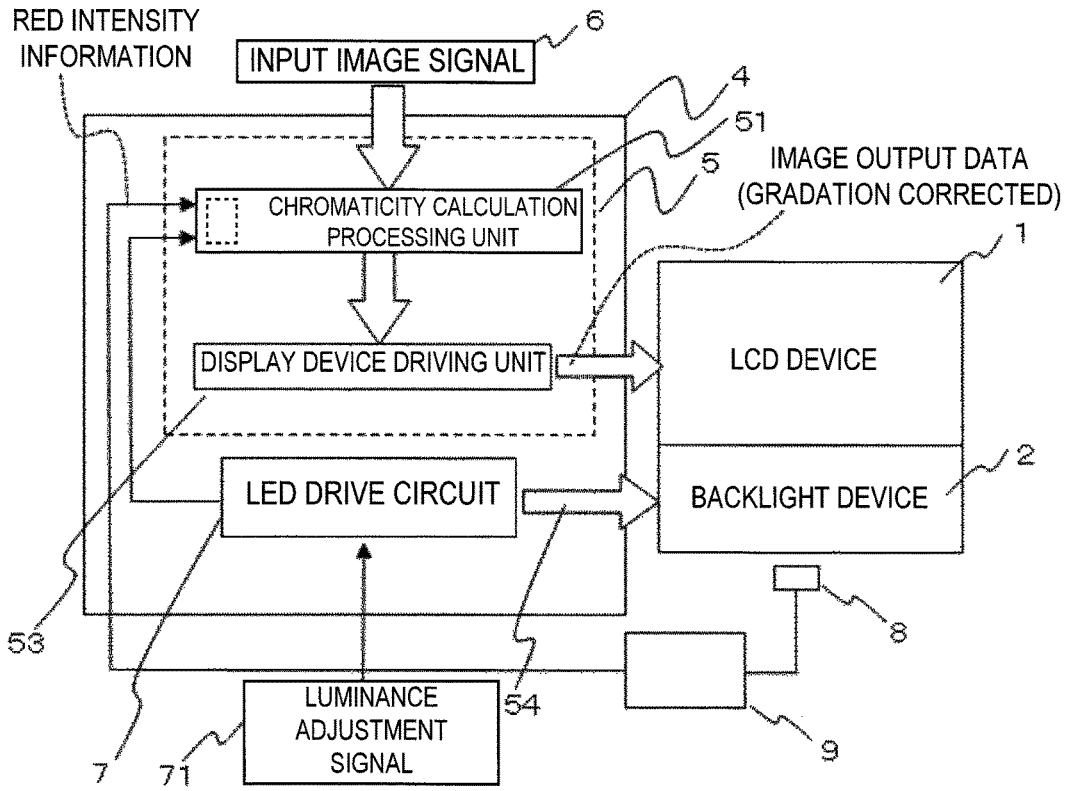
FIG. 12 is a block diagram of a control circuit board which is mounted on the liquid crystal display according to the second embodiment of this disclosure.

FIG. 10 is a block diagram of the control circuit board 4 that receives inputting of an input image signal 6 and a luminance adjustment signal 71 from a display unit supplying the input image signal 6 to the liquid crystal display 100, outputs image output data (output image data) to the LCD device 1, and outputs an LED drive signal 54 to the backlight device 2. Specifically, the control circuit board 4 includes a display control circuit 5 indicated by a dotted line in the drawing and an LED drive circuit 7, and the input image signal 6 and the luminance adjustment signal 71 are input to the control circuit board 4. That is, the luminance adjustment signal 71 is input to the LED drive circuit 7 via a wiring in the control circuit board 4. Here, the luminance adjustment signal 71 is a PWM signal having a duty ratio corresponding to luminance to adjust the luminance of the backlight device 2 to a desired value as described above, and information of the PWM value is output from the LED drive circuit 7 and is input to a chromaticity calculation processing unit 51 via a wiring in the control circuit board 4.

[Characteristics of White LED]

Figure 5:
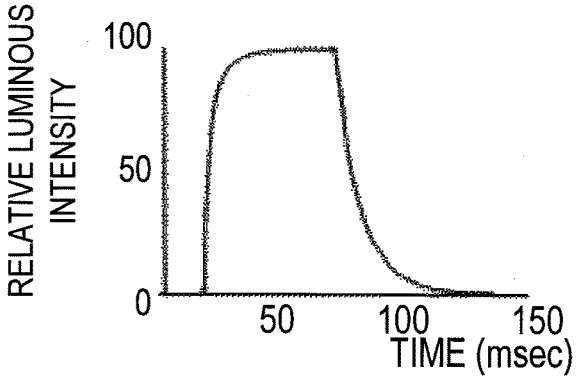
FIG. 5 is a schematic diagram illustrating response characteristics of relative luminous intensity of red fluorescent substance when a rectangular input voltage is applied to the white LED illustrated in FIG. 4.

FIG. 5 is a response characteristic diagram of the relative luminous intensity of red fluorescent substance and the time when the LED drive signal 54 is applied to the white LED 2e1 used in this embodiment. When the blue LED and green fluorescent substance having high responsiveness to light from the blue LED are excited to emit light, a remarkable delay is not caused in responsiveness of the emission intensity with respect to the LED drive signal 54. However, when red fluorescent substance is excited to emit light with light of the blue LED, a delay with respect to an input signal is caused in the temporal characteristics of the emission intensity as illustrated in FIG. 5. This delay results from material characteristics of the fluorescent substance which is used as the red fluorescent substance.

[Luminance Adjusting Operation]

Figure 6:
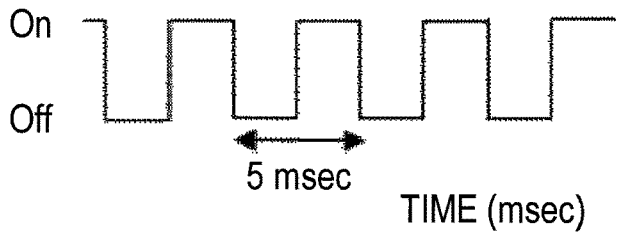
FIG. 6 is a timing diagram illustrating adjustment of brightness of the white LED by PWM according to the first to third embodiments of this disclosure.

FIG. 6 is a waveform diagram of the LED drive signal 54 to the white LED 2e1 when the luminance of the backlight device 2 using the white LED 2e1 as a light source is adjusted in a PWM manner.

Figure 7:
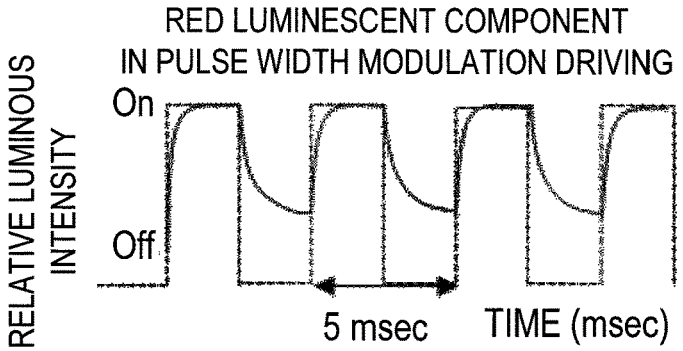
FIG. 7 is a diagram illustrating a correlation between relative luminous intensity emitted from red fluorescent substance and time when the white LED according to the first to third embodiments of this disclosure is driven with a voltage input signal illustrated in FIG. 6.

In adjusting of the luminance of the backlight device 2 using a white LED as a light source, a luminance adjusting method by PWM of adjusting luminance to desired luminance by changing a ratio of ON and OFF (=duty ratio) of a rectangular wave having a constant frequency in a range of 100 Hz to 1000 Hz is generally employed. The luminance adjustment by PWM is employed in this embodiment, and the waveform illustrated in FIG. 6 is a waveform of the LED drive signal 54 at a frequency of 200 Hz and a duty ratio of 50% (=luminance 50%). FIG. 7 is a response characteristic diagram of intensity of light emitted by exciting red fluorescent substance and time when the white LED 2e1 illustrated in FIG. 4 is continuously turned on with the LED drive signal 54 illustrated in FIG. 6.

When the white LED 2e1 is turned on at a duty ratio of 100%, an influence of a responsiveness difference when the fluorescent substance is excited to emit light is not generated and chromaticity matching the designed specification set for the liquid crystal display 100 can be obtained. However, when luminance of the light source unit 2e is adjusted by PWM driving of the white LED 2e1, a difference between the waveform of the LED drive signal 54 and the response waveform of the actual emission intensity is generated for luminescent color of the fluorescent substance having poor responsiveness. As illustrated in FIGS. 5 and 7, when the LED drive signal 54 is in an OFF state but a characteristic that emitted light remains is strong, red is displayed relatively strong with respect to the chromaticity set based on the duty ratio of 100%, and the white chromaticity of the backlight device 2 varies. The chromaticity of the liquid crystal display 100 varies as the result of the white chromaticity variation.

Figure 8:
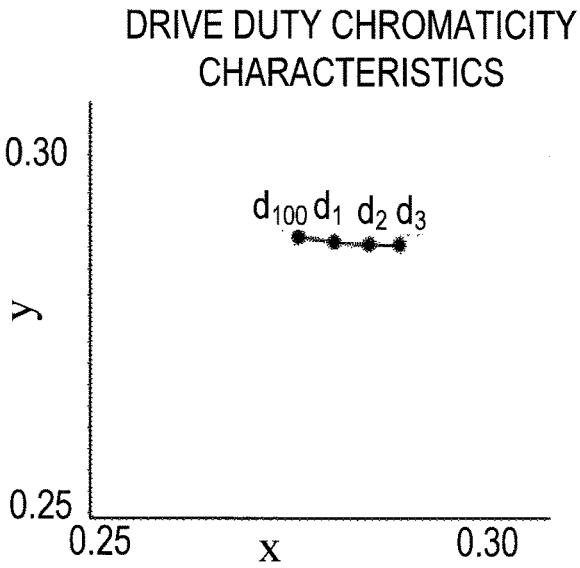
FIG. 8 is a chromaticity diagram illustrating a chromaticity variation of the white LED when a duty ratio of a PWM signal illustrated in FIG. 6 is changed to adjust luminance.
Figure 9:
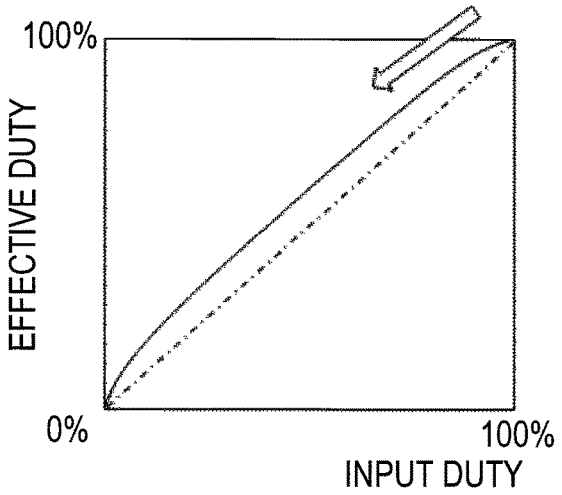
FIG. 9 is a correlation diagram illustrating a relationship between an input duty ratio corresponding to an LED drive signal and an effective duty ratio which can be obtained as relative luminous intensity of red fluorescent substance.

FIG. 8 is a chromaticity diagram illustrating a chromaticity variation of the white LED in a case where luminance is adjusted by changing the duty ratio of the LED drive signal 54. FIG. 9 is a correlation diagram illustrating a relationship between an input duty ratio corresponding to the LED drive signal 54 and an effective duty ratio which can be obtained as relative luminous intensity of red fluorescent substance.

FIG. 8 is a chromaticity diagram illustrating the chromaticity variation of the white LED in a case where luminance is adjusted by changing the duty ratio of the LED drive signal 54 in the liquid crystal display 100 using the white LED 2e1 having the emission spectrum distribution characteristics illustrated in FIG. 4 and the response characteristics of the red fluorescent substance illustrated in FIG. 5 as a light source. In FIG. 8, d100 denotes chromaticity at a duty ratio of 100%. In a case where the duty ratio decreases in the order of d100>d1>d2>d3 (the arrow direction in FIG. 9), the smaller the duty ratio becomes, the larger the difference from the initial chromaticity becomes.

A chromaticity shift phenomenon of the white LED results from the fact that when the white LED 2e1 is driven at the input duty ratio of 0% to 100% as illustrated in FIG. 9, the effective duty ratio which can be obtained as the relative luminous intensity of red fluorescent substance in practice becomes higher at the central part other than both ends of 0% and 100%. This phenomenon results from the fact that the response characteristics of the red fluorescent substance have a worse OFF response as compared to an ON response as illustrated in FIGS. 5 and 7. A straight line indicated by a one-dot chained line in FIG. 9 denotes the effective duty ratio in an ideal LED when there is no response delay of the red fluorescent substance of the white LED 2e1 (which represents a one-to-one linear correlation).

As illustrated in FIG. 8, when the drive duty ratio decreases from 100%, the chromaticity is shifted to the red side and thus the duty ratio corresponding to the shift is added to the drive duty ratio. In FIG. 9, a solid line indicates a correlation curve (nonlinear curve) illustrating a relationship between the input drive duty ratio and the red effective duty ratio, and the difference between the one-dot chained line and the solid line at a specific drive duty ratio corresponds a value requiring any correction.

Accordingly, in white displaying of the liquid crystal display 100, when the white LED is driven in the PWM manner to adjust luminance thereof, a chromaticity variation in white displaying is generated depending on the drive duty ratio. The white displaying means a case where the transmittance of the RGB pixels in the LCD device 1 is maximized. In this embodiment, the input image signal 6 input from the display unit body each has a RGB data configuration of 8 bits and can have gradation levels of 0 to 255.

[Method of Correcting White Chromaticity]

As a countermeasure against the chromaticity shift phenomenon in the white displaying (a case where the gradation of each color of RGB has 255 levels), in this embodiment, responsiveness when fluorescent substance is excited to emit light is grasped in advance, and correction data is added to the original input image signal 6 input to the pixels of the LCD device 1 to input a voltage, thereby suppressing the chromaticity variation.

In the example of this embodiment, since the chromaticity variation in the white displaying mainly results from the response delay of the red fluorescent substance of the white LED, only the red image signal in the input image signal 6 including three colors of RGB is corrected.

Specifically, as a first step, error data of a red component in the chromaticity variation at each duty ratio when the white LED is driven in the PWM manner in the white displaying is grasped by measurement or simulation.

Specifically, at the above-mentioned duty ratios, correction data (gradation correction data) corresponding to the gradation levels of the input image signal 6 of the luminescent color (red in this embodiment) serving as a reason of the chromaticity variation is calculated for the error data of the red component.

In this embodiment, the duty ratio at which the correction data is measured is changed by 10%. Accordingly, except the duty ratio of 0% (a state where the white LED is not turned on) and the duty ratio 100% (a state where the white LED is continuously turned on), nine types of correction data of 10% to 90% is measured. Specifically, the duty ratio is fixed to a measurement value, the liquid crystal display 100 is made to perform white displaying (the maximum gradation value in RGB, that is, 255 of gradation level), the gradation value of a red image signal decreases from the maximum gradation value, and a decrease width is measured to be closest to the chromaticity value at the duty ratio of 100% and is recorded as correction data. Thereafter, the decrease width is similarly measured and recorded while the duty ratio is changed by 10%, and total nine types of correction data are obtained.

Similarly, the color gradations of RGB in the white displaying decrease by one bit into 254 of gradation level at a time, the above-mentioned first step is performed, and red correction data when the white LED is driven at the duty ratios of 10% to 90% in display of 254 gradation is obtained. Thereafter, similarly, the same step is repeatedly performed from the 253 of gradation level to the first gradation and 256 pieces of red gradation correction data corresponding to the nine duty ratios are obtained (the zero gradation, that is, black display, does not require correction and thus 255 gradation values may be used, but the correction data thereof is held as 0).

Then, in a second step, a data table 10 having nine numbers which correspond to the nine types of duty ratios and in which correction values corresponding to the gradation of the input image signal is stored is prepared, and the duty ratios are correlated with the table numbers to store 256 correction values. That is, when a specific duty ratio is designated, it is possible to read out the correction values of the red image signal corresponding to the gradation values of 0 to 255 of the input image signal 6.

FIG. 11 illustrates an example of the data table 10. As illustrated in the drawing, correction values corresponding to the 256 gradation values for each duty ratio of 10% to 90% (the duty ratios of 20%, 30%, 70%, and 80% are omitted). That is, when a specific duty ratio is designated, it is possible to read out the correction values of the red image signal corresponding to the gradation values of 0 to 255 of the input image signal 6.

Then, a third step is a step for actually displaying an image on the LCD device 1. In this step, an image input is corrected based on information of the luminance correction value of the backlight device 2, that is, information on the PWM signal (information on the duty ratio).

[Operation of Display Control Circuit]

In the display control circuit 5, the chromaticity calculation processing unit 51 performs a calculation process on a color in which the chromaticity is shifted in the PWM based on the gradation correction data which is written in advance using the information of the duty ratio of the PWM signal output from the LED drive circuit 7 (luminance control unit), generates a corrected image signal, and outputs the corrected image signal as image data to a display device driving unit 53.

Specifically, in this embodiment, the response delay of the red fluorescent substance is corrected, the gradation correction data stored in the data table 10 is read using the duty ratio as a parameter based on the gradation value of the red input image signal 6, the gradation correction data is subtracted from the input gradation value, and the resultant is output as red image data to the display device driving unit 53.

Then, the display device driving unit 53 having received the image data drives the LCD device 1 using the corrected red image output data and non-corrected blue or green image data, other timing signals (not illustrated), or the like.

In this way, it is possible to obtain display of constant chromaticity regardless of the response characteristics when fluorescent substance is excited to emit light and the duty ratio of the PWM signal.

[Effect]

In an image which is actually displayed based on the gradation-corrected output data to the LCD device, the chromaticity variation of the white LED light source of the backlight which results from the luminance adjustment by PWM is cancelled by the gradation correction of the pixels of the color and it is possible to hold constant chromaticity regardless of the luminance.

As described above, in the liquid crystal display 100 according to this disclosure, even when the luminance of the backlight device 2 is adjusted by PWM using the white LED corresponding to an optical color reproducible range in which a blue LED and fluorescent substance having an emission peak in wavelength regions of green and red are combined, the chromaticity variation due to the response characteristics of the LED fluorescent substance can be cancelled by performing the gradation correction on the input image data and the chromaticity in the original product specifications can be maintained regardless of setting of display brightness.

In the first embodiment, plural white LEDs **2*e*1 are arranged on the light source substrate 2*e*2**, but the number of white LEDs does not need to be two or more and may be only one as long as the light intensity is sufficient.

[Modified Example]

In the first embodiment, an edge light type backlight in which the light source unit **2*e* is disposed on the side surface of the light guide plate 2*c* has been exemplified as illustrated in FIG. 1, but the same advantages can be obtained even in a so-called direct backlight in which the light guide plate 2*c* is not provided and light sources are arranged at constant intervals on the substantially entire surface of the bottom of the rear frame 2*f* facing the rear surface of the LCD device 1**.

[Second Embodiment]

In the first embodiment, the gradation correction data corresponds to the duty ratios of the PWM signal for driving the white LED and quantified numerical data is stored in a data table in the display control circuit 5. However, in a second embodiment of this disclosure, a chromaticity sensor 8 is additionally installed in or in the vicinity of the backlight device 2 in addition to the configuration of the first embodiment, the red component is extracted from the chromaticity value measured by the chromaticity sensor 8 by a color component analyzing circuit 9 (a filtering process of passing red), and red intensity information (red intensity data) is input as a feedback signal to the display control circuit 5. The chromaticity calculation processing unit 51 in the display control circuit 5 receives the red intensity information, compares the red intensity information with the original chromaticity specification, and calculates the gradation correction value by a calculation process, thereby calculating an output to the LCD device 1.

At this time, the PWM information described in the first embodiment is used to determine the initial value of the gradation correction data in the numerical calculation. The chromaticity calculation processing unit 51 determines the initial value of the gradation correction data in the numerical calculation based on the PWM information input from the LED drive circuit 7, to match the chromaticity with predetermined white chromaticity based on the red intensity information.

Specifically, the chromaticity calculation processing unit 51 feeds back the red intensity information to the red gradation correction of the output image data output from the display device driving unit 53. That is, the value stored in the data table 10 in which the duty ratio of the PWM signal and the input gradation value are used as parameters is set as the initial value of the gradation correction data, the red intensity information is compared with predetermined red intensity calculated from the designed specification, a process of increasing the initial value of the gradation correction data by one gradation (=decreasing the gradation value of the red display by 1) is performed when the red intensity information is larger, and a process of decreasing the initial value of the gradation correction data by one gradation (=increasing the gradation value of the red display by 1) is performed when the red intensity information is smaller. By repeatedly performing this correction operation (the operation of increasing and decreasing the correction data), the red intensity information is matched with the predetermined red intensity.

In this way, by disposing the chromaticity sensor 8 and the color component analyzing circuit 9 in or in the vicinity of the backlight device 2 and causing the chromaticity calculation processing unit 51 to use the PWM information and the red intensity information for the calculation process, it is possible to rapidly and accurately match the white chromaticity of the liquid crystal display 100 with a predetermined value with small unevenness.

In the second embodiment, the chromaticity sensor 8 and the color component analyzing circuit 9 are used to measure the intensity of the red component of the backlight device 2, but the same advantages can also be obtained by combination of an operation filter (red filter) passing only a red wavelength component and a photo resist reacting with the wavelength thereof or a light-receiving sensor (corresponding to an optical sensor).

[Third Embodiment]

In addition to the configuration of the first embodiment, the front surface of the LCD device 1 may be provided with a touch panel for inputting a position signal on a screen from the outside and a substantially transparent protective member (both of which are not illustrated) for protecting the touch panel, and the rear surface thereof may be provided with a cover (not illustrated) for protecting the control circuit board 4.

[Touch Panel]

The touch panel (not illustrated) converts information on a positional coordinate input from the outside (a user) into an electrical signal through the use of circuits using transparent electrodes formed on a transparent substrate, and transmits the electrical signal to a control circuit of a final product via an output wiring unit connected to an end thereof. An FPC in which wirings are formed on a film-like substrate is used as the output wiring unit in view of a degree of freedom in connection by thinness and flexibility, and a wiring unit formed of different materials with different structures may be used as long as it has the same function and characteristics.

The touch panel may include a protective member (not illustrated) formed of a transparent material such as glass or plastic on the front surface side so as to suppress damage, deformation, abrasion, contamination, and the like due to pressing or contact from an input surface side, and printing may be applied to the periphery of the front surface or the rear surface of the protective member for the purpose of light blocking or design improvement.

In the first to third embodiments, the component varying from the set chromaticity specification due to the fluorescent substance having poor responsiveness which is used for the white LED is assumed to be red, but the fluorescent substance having poor responsiveness is not limited to red and may be fluorescent substance emitting other color. In addition, the fluorescent substance is not limited to one color, and fluorescent substance of plural colors can be coped as long as gradation correction data corresponding to the plural colors can be prepared.

What is claimed is:

1. A liquid crystal display comprising:

a liquid-crystal-display device, which includes a color filter substrate and a thin-film-transistor substrate;

a display control circuit, which generates an image signal to control display of the liquid-crystal-display device;

a backlight device, which is disposed on a rear surface of the liquid-crystal-display device, includes at least one white light emitting diode, and emits planar light from an emission surface; and a light-emitting-diode control circuit that adjusts luminance of the backlight device using a pulse width modulation signal as an output to the white light emitting diode, wherein gradation correction data corresponding to a chromaticity variation due to a duty ratio of the pulse width modulation signal is stored in the display control circuit in advance, the display control circuit determines the gradation correction data corresponding to input image data input to the liquid crystal display, based on the input image data and the duty ratio, and the display control circuit outputs output image data, which is calculated based on the gradation correction data and the input image data so as to correct the chromaticity variation caused by a response delay that occurs in a fluorescent material, used to produce a light, when driving the white light emitting diode, as the image signal to the liquid-crystal-display device.

2. The liquid crystal display according to claim 1, wherein the display control circuit outputs the output image data, which is calculated based on the gradation correction data and the input image data, as an image signal for a red pixel to the liquid-crystal-display device.

3. The liquid crystal display according to claim 2, wherein an optical sensor measuring intensity of light emitted from the backlight and a filter extracting red are combined to generate red intensity data, and the gradation correction data is changed based on the red intensity data.

4. The liquid crystal display according to claim 1, wherein an optical sensor measuring intensity of light emitted from the backlight and a filter extracting red are combined to generate red intensity data, and the gradation correction data is changed based on the red intensity data.

* * * * *